US009585497B2

(12) United States Patent
Luo et al.

(10) Patent No.: US 9,585,497 B2
(45) Date of Patent: Mar. 7, 2017

(54) MODULAR DISPLAY SYSTEM

(71) Applicant: The Procter & Gamble Company, Cincinnati, OH (US)

(72) Inventors: Xuefen Luo, Guangzhou (CN); Jackson Chi-Yu Wang, Guangzhou (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/630,034

(22) Filed: Sep. 28, 2012

(65) Prior Publication Data

US 2013/0081311 A1 Apr. 4, 2013

(30) Foreign Application Priority Data

Sep. 30, 2011 (WO) ..... PCT/CN2011/80468

(51) Int. Cl.

| | |
|---|---|
| ***A47B 43/00*** | (2006.01) |
| ***A47F 5/00*** | (2006.01) |
| ***A47F 7/28*** | (2006.01) |

(52) U.S. Cl.

CPC ..... *A47F 5/0025* (2013.01); *A47F 5/0062* (2013.01); *A47F 7/286* (2013.01)

(58) Field of Classification Search

USPC ..... 40/651; 211/119.003, 134, 153

See application file for complete search history.

(56) References Cited

U.S. PATENT DOCUMENTS

| | | | | |
|---|---|---|---|---|
| 3,814,110 | A | 6/1974 | Cassidy | |
| 3,853,220 | A * | 12/1974 | Luray | 206/466 |
| 3,976,588 | A | 8/1976 | McLaughlin | |
| 4,066,746 | A | 1/1978 | Callingham | |
| 4,135,524 | A | 1/1979 | Rosenberg | |
| 4,183,367 | A | 1/1980 | Goebel | |
| 4,494,658 | A * | 1/1985 | Simon et al. | 211/49.1 |
| 4,657,149 | A * | 4/1987 | Masson | 211/194 |
| 4,673,568 | A | 6/1987 | Grollier | |
| 4,762,235 | A * | 8/1988 | Howard et al. | 211/59.3 |
| 4,844,264 | A * | 7/1989 | Deskiewicz, Jr. | 211/50 |
| 4,973,476 | A | 11/1990 | Krzysik | |
| 5,014,862 | A * | 5/1991 | Bustos | 211/193 |

(Continued)

FOREIGN PATENT DOCUMENTS

| | | |
|---|---|---|
| CA | 1123338 A1 | 5/1982 |
| DE | 2918380 A1 | 11/1979 |

(Continued)

OTHER PUBLICATIONS

Drying & Shine Accelerator, Record ID 552154; Jean-Marc Maniatis, www.gndp.com.

(Continued)

*Primary Examiner* — Shin Kim

(74) *Attorney, Agent, or Firm* — Linda M. Sivik

(57) ABSTRACT

A modular product display system comprising a first horizontal shelf having opposing ends; two or more display panels disposed on a top surface of said first horizontal shelf; one or more side walls, each having a height and supporting each opposing end of said shelf; wherein said display panels are modular and each comprise a rear panel perpendicularly disposed to a bottom panel suitable for product placement.

18 Claims, 5 Drawing Sheets

(56) References Cited

U.S. PATENT DOCUMENTS

| | | | | |
|---|---|---|---|---|
| 5,096,272 | A | 3/1992 | Belokin, Jr. | |
| 5,379,905 | A * | 1/1995 | Bustos et al. | 211/59.2 |
| 5,567,428 | A | 10/1996 | Hughes | |
| 5,645,182 | A | 7/1997 | Miller, Jr. | |
| 6,364,132 | B1 * | 4/2002 | Feng | 211/43 |
| 6,451,747 | B1 | 9/2002 | Decoster | |
| 6,802,146 | B2 * | 10/2004 | Gay | 40/651 |
| 6,874,646 | B2 * | 4/2005 | Jay | 211/59.2 |
| 7,152,740 | B1 * | 12/2006 | Chang | 206/764 |
| 7,997,430 | B2 * | 8/2011 | Clark et al. | 211/186 |
| 8,123,052 | B2 * | 2/2012 | Clark et al. | 211/186 |
| 8,317,039 | B2 * | 11/2012 | Norman | 211/60.1 |
| 2004/0029981 | A1 | 2/2004 | Herzig | |
| 2006/0041026 | A1 | 2/2006 | Mahr | |
| 2008/0087621 | A1 | 4/2008 | Zang | |
| 2008/0151531 | A1 | 6/2008 | Richardson | |
| 2008/0251481 | A1 | 10/2008 | Pustinger | |
| 2010/0065523 | A1 * | 3/2010 | Northrup et al. | 211/90.02 |
| 2010/0320109 | A1 * | 12/2010 | Trumbauer et al. | 206/386 |
| 2010/0326939 | A1 | 12/2010 | Clark | |
| 2011/0114578 | A1 | 5/2011 | Jacobs | |
| 2012/0097630 | A1 | 4/2012 | Wang | |
| 2013/0213912 | A1 * | 8/2013 | Naha | 211/85.4 |

FOREIGN PATENT DOCUMENTS

| | | | |
|---|---|---|---|
| EP | 477057 | A1 | 3/1992 |
| EP | 884013 | A1 | 12/1998 |
| EP | 914079 | A1 | 9/2002 |
| JP | H2-141259 | | 11/1993 |
| JP | H7-16133 | | 1/1995 |
| JP | 2000344633 | A | 12/2000 |
| JP | 2003286137 | A | 10/2003 |
| JP | 2007153806 | A | 6/2007 |
| WO | 9427570 | A1 | 12/1994 |
| WO | 9746210 | A1 | 12/1997 |
| WO | 9831255 | A1 | 7/1998 |
| WO | 2007778485 | A1 | 6/2007 |
| WO | 2009751505 | A1 | 10/2009 |
| WO | 2009751506 | A1 | 11/2009 |
| WO | 2009155225 | A1 | 12/2009 |

OTHER PUBLICATIONS

Fast Dry Shampoo; L'Oreal Kids, Record ID 675343; www.gnpd.com.

Rapid Drying Shampoo; J.F. Lazartigue; Record ID 10073717; www.gnpd.com.

Speed-Dry Styling Spray Frederic Fekkai; Record ID 645259; www.gnpd.com.

International Search Report PCT/CN2011/080468; Mailing Date Jul. 12, 2012; 11 pages.

* cited by examiner

MODULAR DISPLAY SYSTEM

CROSS REFERENCE TO RELATED APPLICATIONS

This application claims the benefit of PCT Application No. PCT/CN2011/080,468 filed on Sep. 30, 2011.

FIELD OF THE INVENTION

The present invention relates to a modular product display system useful in retail environments. This invention is particularly useful when it is desirable to rearrange product displays quite readily for one reason or another.

BACKGROUND OF THE INVENTION

Display systems have been used in the retail context for a long time. They serve multiple functions in stores. For instance, they are useful for displaying and providing an organized presentation of products to consumers in a compact space. They are also useful for providing consumers with information on the capabilities and benefits associated with the displayed products. Moreover, these same display systems may act as "calling cards" for certain manufacturers since the display systems may and tend to be representative of the product's brand equity. In other words, certain displays are very apparently associated with a particular product from a particular manufacturer based on color choice, signage, and in some instances even a pleasant, characteristic fragrance.

Commonly used product display systems or arrangements include one or more rigid shelves, likely metal shelves, placed in parallel to one another at varying or similar distances based on the products to be displayed. The shelves are joined to a stationary rearward panel and are supported by undermounted brackets spaced along the length of the shelves. Typically, there is signage with product information wherein the signage is either above the products or alongside the products. There may even be signage posted on one or more side walls joined to the ends of these shelves in parallel. In most instances, these display arrangements tend to be fairly fixed and not so easily swapped out when new product display arrangements are required. These arrangements also tend to be tied to a single product type or product line-up as may be evidenced by the particular coloration of the static rear wall and shelving that is used. Therefore, they tend not to offer the flexibility that retailers seek to provide to their distributors who might have changing product offerings over a short period of time.

The present invention seeks to address a retailer's need to provide a flexible retail environment that is pleasing to both his supplier (who is now able to vary his product offerings within a limited amount of display space) and his consumer (who is interested in his/her ability to purchase a variety of products at will).

SUMMARY OF THE INVENTION

In one aspect, the present invention is related to a modular product display system comprising:

a. a first horizontal shelf having opposing ends;

b. two or more display panels disposed on a top surface of said first horizontal shelf;

c. one or more side walls, each having a height and supporting each opposing end of said shelf;

wherein said display panels are modular and each comprise a rear panel perpendicularly disposed to a bottom panel that is suitable for product placement.

DETAILED DESCRIPTION OF THE INVENTION

As used herein, "modular" means designed with standardized units or dimensions to permit easy assembly and easy, flexible interchangeability. "Modular" further connotes that an element, e.g., a display panel can be arranged or fitted together with others in a variety of ways.

As used herein, the term "perpendicular" means one surface or plane is generally disposed at a right angle, e.g., an L shape, relative to a second surface or plane. However, Applicant intends that this definition of perpendicular also encompass obtuse angles within 45 degrees of vertical and acute angles within 45 angles of vertical.

The present invention relates to a modular product display system suitable for use in retail environments to present consumers with a flexible offering of products within a limited amount of space. This means that the present invention targets to give retailers, suppliers, and consumers the option of providing not only constantly variable product offerings but similarly changing display portions that focus on educating the consumer via product sample presentation, product description, and product benefit explanation. In particular, this flexibility results from a modular display panel configuration that is placed on a shelf wherein the configuration is easily adaptable, e.g., adjustable in size, for accommodation of either a greater or lesser number of products. This development is particularly focused on providing a plurality of rather easily interchangeable display panels that can be arranged on a shelf and convey one or more product messages to a consumer. Then, with minimal effort, replacement display panels may be inserted or removed wherein these panels contain different advertisement content to accommodate 1) an expanded offering of the same product, 2) a narrowed offering of the same product, 3) an expanded offering of the same product along with additional products, or 4) a replacement product of the same type, or 5) an entirely different product type.

Figure 1:
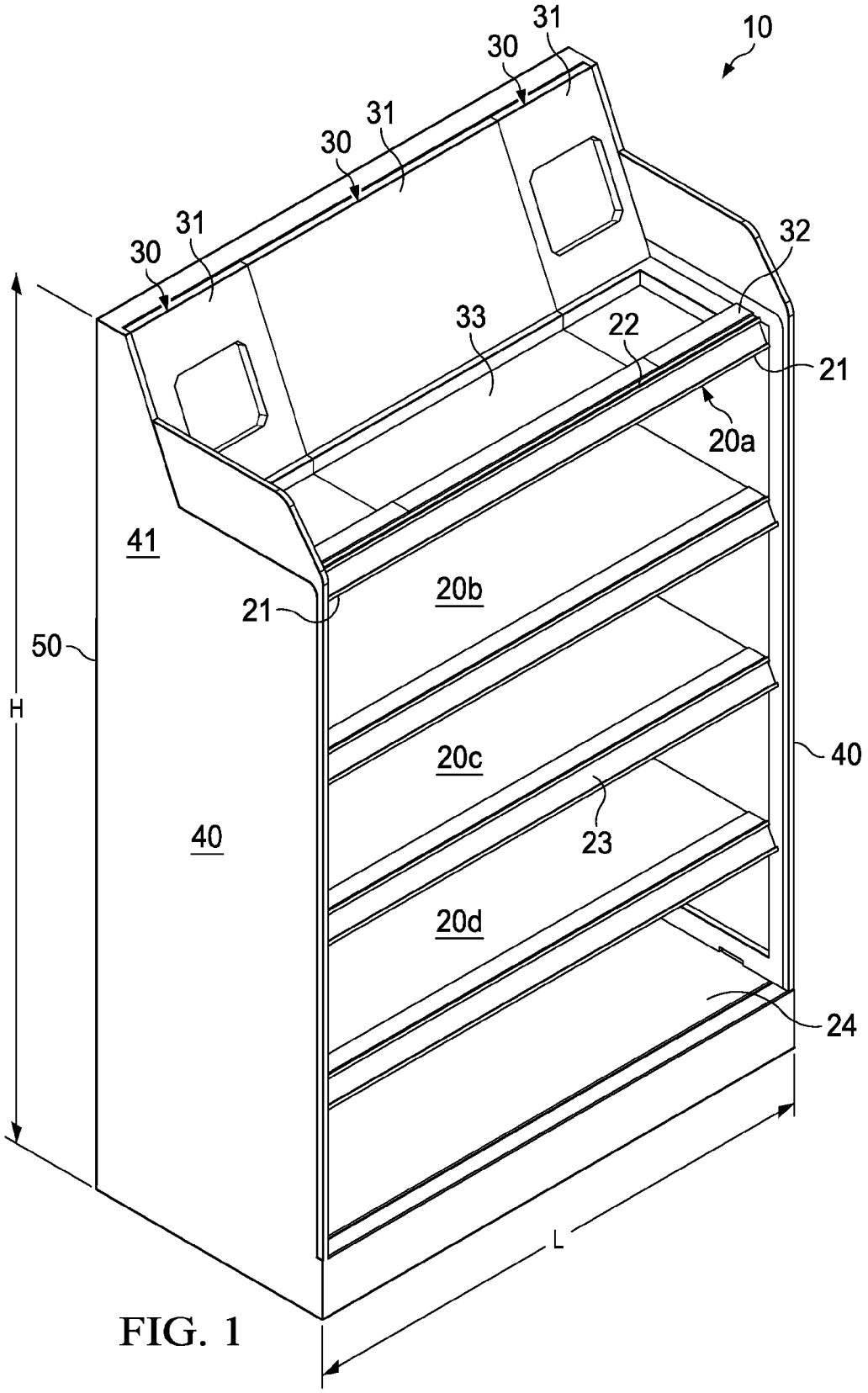
FIG. 1 illustrates a perspective view of a modular product display system according to the present invention.

In one embodiment as illustrated in FIG. 1, the modular product display system 10 comprises a first horizontal shelf (20*a*) having opposing ends (21). This shelf (20*a*) is formed of a rigid material, e.g., steel, aluminum, plastic, ceramic, or wood, and has a length L that spans between opposing ends (21). These opposing shelf ends (21) are supported by opposing side walls 40, particularly at a top end (41) of the first horizontal shelf (20*a*). Thus, the shelf (20*a*) may be fixedly or removably supported by the side walls. These side walls have a height H, which ideally provide a modular product display system that is easily accessible to consumers to promote product testing, product awareness, and product education. The side walls likewise may be fixedly or removably joined to a base portion (24) that spans the length L of the first horizontal shelf (20*a*). The shelf (20*a*) has a front surface (23) and a top surface (22) as well as other external surfaces like a bottom surface or a rear surface. It should be noted that there may be additional horizontal shelves (20*b*, 20*c*, 20*d*), all suitable for placement of retail product. Here, two or more display panels (30) are disposed on the top surface of the first horizontal shelf (20*a*). These display panels (30) may be adjacent to but disconnected from one another, adjacent and connected to one another, separated by a minimal or substantial distance along the shelf's length, or merely placed in a touching position along this shelf (20*a*). The display panels (30) may be connected to one another to form a unitary display panel. In some embodiments, they may actually be connectedly fixed to the shelf (20*a*) in a particular position via a snap fit (e.g., male-female connection) or sliding engagement with a grooved portion of said shelf (20*a*). In these arrangements, the display panels (30) would slide in place from an opposing end (21) in the absence of the respective side wall (40). Similarly, the one or more display panels (30) may be connected to each other via the same type of snap fit that is present along respective adjacent lateral edges of the panels. The display panels (30) further comprise a rear panel (31) which is perpendicularly disposed to a bottom panel (32). This relationship between the rear panel (31) and the bottom panel (32) practically form an L shape. This L shape permits for product placement on or near the bottom panel (32). In particular, the one or more of the bottom panels (32) may comprise a channel (33). Thus, if multiple display panels (30) are placed adjacent to one another or joined at their respective lateral edges, it is possible that the channels (33) of each panel (32) are joined to the other channels (33) to form a lengthier product display panel which now comprises a lengthier channel. This adjacency or joining of channels (33) between display panels (30) is not required but is suitable for a larger product display.

Figure 2:
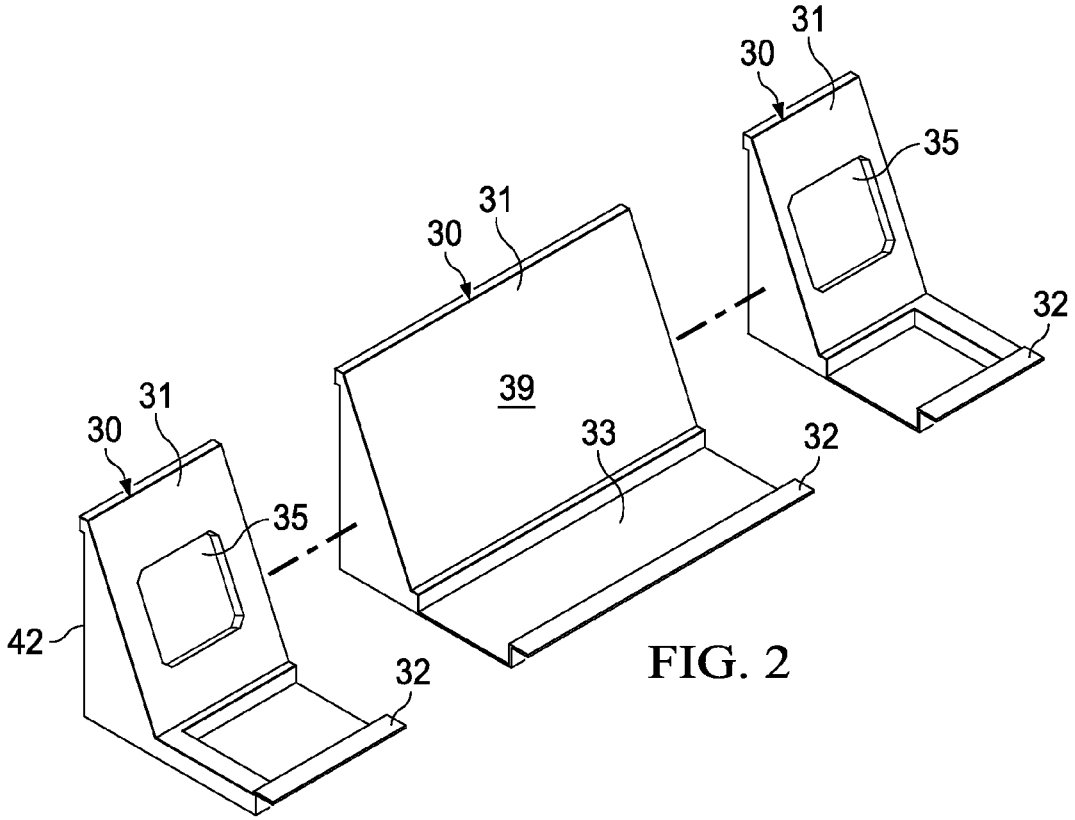
FIG. 2 illustrates a perspective view of display panels suitable for use in the present invention.

FIG. 2 depicts an exploded view of solely the display panels (30) contained in FIG. 1. The display panel (30) features which were highlighted in FIG. 1 are also shown in FIG. 2. These include the rear panel (31), the surface display (35), the bottom panel (32), and the channel (33). The product-facing surface (39) of the display panel (30) is also shown. The rearward facing surface (42) of the display panel (30) may or may not be arranged or set flush to a rear wall (50) (shown in FIGS. 1 and 6) of the system.

Figure 3:
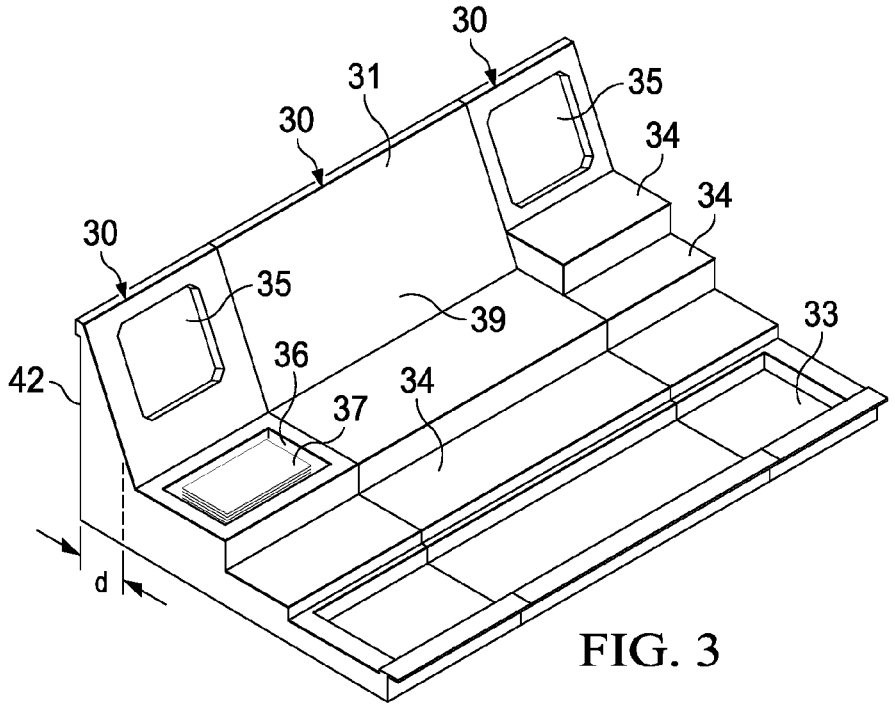
FIG. 3 similarly illustrates a perspective view of another embodiment of suitable display panels suitable for use in the present invention.

FIG. 3 illustrates an alternate configuration of the one or more display panels (30). Here, three display panels (30) are shown. The two display panels (30) on the respective opposing outward ends of the three adjacent display panel configuration comprise display panels (30) as shown in FIG. 2. The intermediate display panel (30) lacks a surface display (35) on the rear panel (31) and more particularly on the product-facing surface (39) but rather it is blank in this instance to accommodate actual product samples which may be placed on one or more of the graduated levels (34). These bottom panels (32) comprise the one or more graduated levels (34) and such levels may also be present in the other adjacent display panels (30) or not. Alternatively, the graduated levels (34) of a particular display panel (30) may differ in depth, height, and number when compared to those contained in adjacent display panels (30) as shown in FIG. 2. This variety allows for placement of products of different sizes on different graduated levels (34) within an area of the display panel (30) without necessarily blocking the display. For instance, a retailer may choose to place a taller product on a graduated level adjacent to the front surface of the shelf (20*a*) to permit viewing of the surface display (35) on the rear panel (31). The rightmost display panel (30) comprises 3 graduated levels (34), the intermediate and leftmost display panels (30) each comprise 2 graduated levels (34). The leftmost display panel (30), however, comprises a recessed portion (36) that is suitable for containing a product information medium (37). The recessed portion (36) may take a variety of shapes including, but not limited to, rectangular, circular, elliptical, triangular, hexagonal, etc. The product information medium (37) comprises a format selected from the group consisting of a paper sheet, a card, a pamphlet, a CD, a DVD, a jump drive, a memory car. Any of these product information media (37) may contain print, audio, video, or other digitally stored product information, including health and safety information, product benefit explanations, promotional information, complementary product introductions, or any other useful content that educates the consumer why he/she should purchase the displayed products. Also depicted in this figure is a continuous channel formed by the adjacency of the respective channels (33). This series of shorter channels is positioned in front of the graduated levels (34).

It should also be noted that the display panels (30) discussed herein are shown as having a substantial depth d between a rearward-facing surface (42) of each rear panel (31) and a product-facing surface (39) of each rear panel (31). It is also intended that the present invention encompass display panels (30) where depth d is only millimeters thick. That is, the product-facing surface (39) and the rearward-facing surface (42) of the rear panel (31) are in substantially the same plane or where the thickness between the two surfaces is minimal but existent. A similar depth d is applicable as measured from the bottom panel's upward facing surface.

Figure 4:
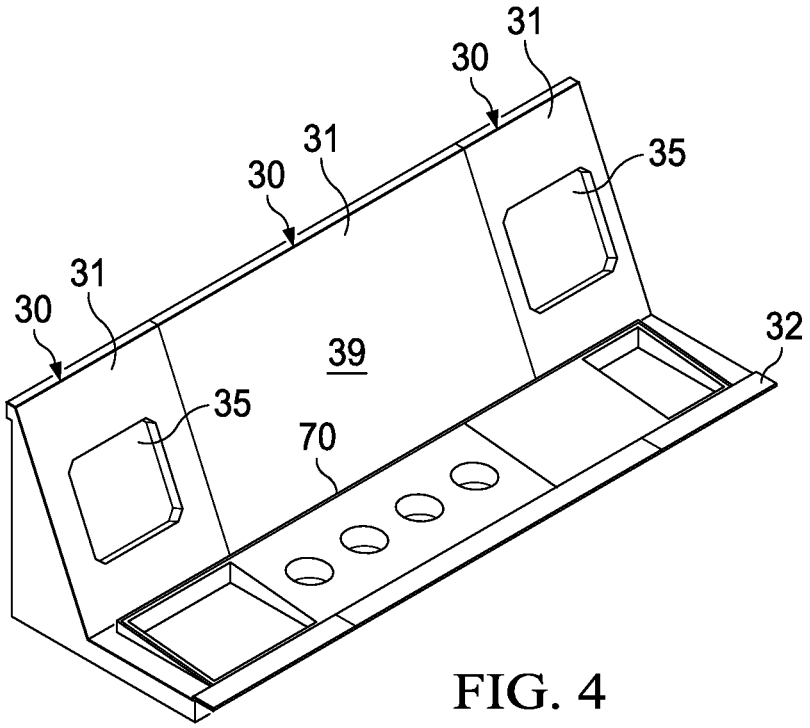
FIG. 4 illustrates a perspective view of the display panels of FIG. 2 paired with a product display tray as detailed in the present invention.

FIG. 4 shows the same display panels (30) of FIG. 2 in an adjacent arrangement. In this arrangement, the channel (33) of one display panel (30) or a series of channels formed by multiple display panels (30) accommodate the insertion of a product sample display tray (70). In this particular embodiment, the tray (70) spans the length of three display panels (30). Alternatively, the tray (70) may only span a portion of a single display panel (30) or even the full length of one or more of the display panels (30) as well as a portion of another display panel (30) which may be adjacent a fully spanned display panel (30). The product sample display tray (70) comprises product reception areas (38) for fixed or removable placement of product display samples as well. For instance, in FIG. 4 the taller product display samples are placed in the area of the tray (70) which coincides with the intermediate display panel (30). The product-facing surface (39) of the rear panel (31) of this intermediate display panel (30) may or may not include a surface display (35). Moreover, it should be appreciated that the product-facing surface (39) of this display panel (30) as well as any of the others may be set an obtuse angle relative to said bottom panel (32). This allows for easy viewing of the surface displays (35) across a continuum of display panels (30) or even on only one or more separated display panels (30), particularly from a distance. The surface display (35) may be selected from the group consisting of a product logo, a key visual, product description, or combinations thereof. The surface displays (35) of the one or more display panels (30) may be the same or they may be different from one another along the length of the shelf (20*a*).

Figure 5:
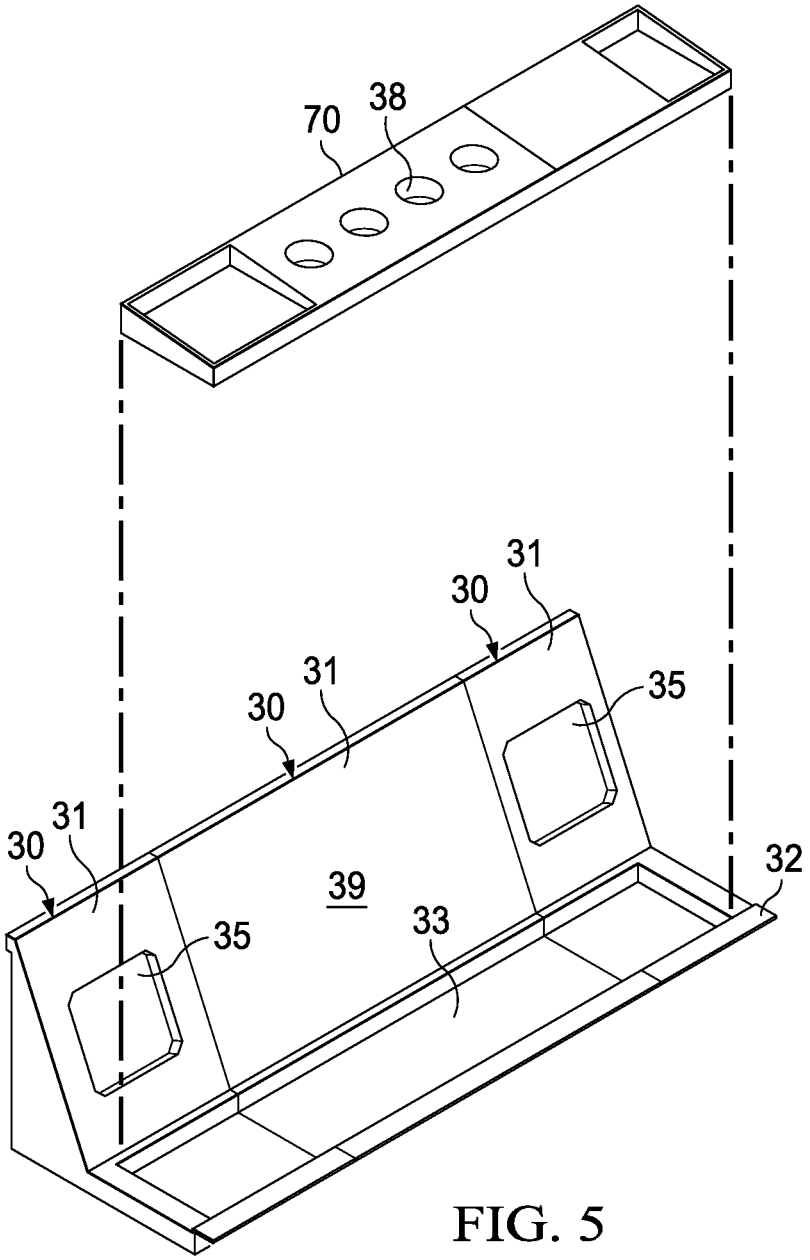
FIG. 5 illustrates an exploded view of FIG. 4.

FIG. 5 merely shows an exploded view of the configuration of the two layers of the display panels and tray.

Figure 6:
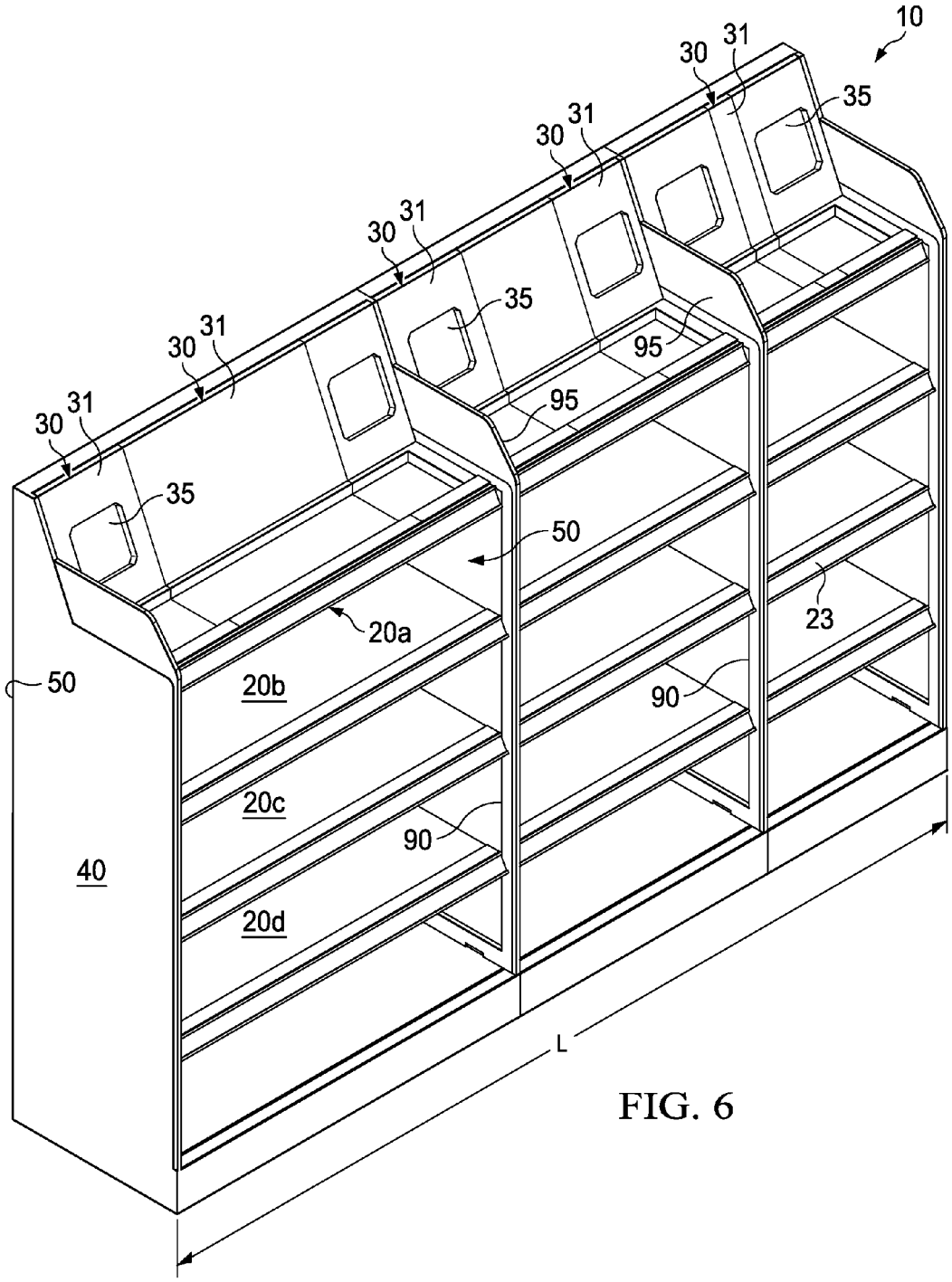
FIG. 6 illustrates a perspective view of another embodiment of the present invention which additionally comprises movable partitions.

In another embodiment, as shown in FIG. 6, particularly a lengthier modular product display system (10), one or more movable partitions (90) are positioned perpendicular to a front surface (23) of the first horizontal shelf (20*a*) along a height H of the side walls (40). As can be seen in this embodiment, the movable partition (90) may comprise a solid planar top portion (95) suitable for placement between the display panels (30) to help segregate product offerings from each other when placed along the length of the first horizontal shelf (20*a*). Additionally, the movable partition (90) may be fairly open along the height H of the system (or side wall 40) versus having a solid planar surface that juts into the shelf (20*a*) space to delineate product offerings. In other words, the movable partition (90) may in this instance separate the display panels (30) on the first horizontal shelf (20*a*) while permitting commingling of product types on said additional shelves along the height H of the side walls (40). On the other hand, the movable partition (90) may be largely solid and planar and have slit openings that accommodate the first horizontal shelf (20*a*) and any additional horizontal shelves (20*b*, 20*c*, 20*d*) comprised in a parallel configuration in this system.

In even yet another embodiment, the side walls (40) may be removable and the first horizontal shelf (20*a*) is additionally supported by a rear wall (50) that is perpendicularly joined to and between said side walls (40).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A modular product display system (10) comprising:

a. a first horizontal shelf (20*a*) having opposing ends (21);

b. two or more display panels (30) disposed on a top surface (22) of said first horizontal shelf (20*a*);

c. one or more side walls (40), each having a height h and supporting each opposing end of said shelf (20*a*) wherein said display panels (30) are modular and each comprises a rear panel (31) perpendicularly disposed to a bottom panel (32) that is suitable for product placement, said display panels (30) are connected to one another to form a unitary display panel and wherein one or more of said bottom panels comprises a channel (33) and graduated levels (34) placed adjacent to one another and wherein a product display sample tray (70) is disposed within said channel (33) and wherein the display sample tray (70) spans full length of the display panels (30).

2. The system of claim 1 wherein said display panels (30) are fixed to said shelf (20*a*) via snap fit.

3. The system of claim 1 wherein said display panels (30) are slidably disposed on said shelf (20*a*).

4. The system of claim 1 wherein said rear panel comprises a product-facing surface (39).

5. The system of claim 4 wherein said product-facing surface is set an obtuse angle relative to said bottom panel.

6. The system of claim 4 wherein said product-facing surface comprises a surface display (35) which is selected from the group consisting of a product logo, a key visual, product description, or combinations thereof.

7. The system of claim 6 wherein the surface displays of the one or more display panels (30) are the same from one another along the length of the shelf 20*a*.

8. The system of claim 1 wherein said bottom panel comprises a recessed portion (36).

9. The system of claim 8 wherein said recessed area contains a product information medium (37).

10. The system of claim 1 wherein said first horizontal shelf (20*a*) is supported toward a top end (41) of said side walls.

11. The system of claim 1 wherein said side walls are removable and said shelf (20*a*) is additionally supported by a rear wall (50) that is perpendicularly joined to and between said side walls.

12. The system of claim 1 wherein said side walls are removably joined to a base portion (24) that spans a length 1 of said first horizontal shelf (20*a*).

13. The system of claim 1 wherein said system further comprises additional horizontal shelves ((20*b*), (20*c*), (20*d*), etc.) positioned along a height of said side walls.

14. The system of claim 1 wherein said system further comprises a movable partition (90) positioned perpendicular to a front surface (23) of said first horizontal shelf 20*a* along a height of said side walls.

15. The system of claim 14 wherein said movable partition comprises a solid planar top portion (95) suitable for placement between said display panels (30).

16. The system of claim 14 wherein said movable partition (90) separates said display panels (30) on said first horizontal shelf (20*a*) while permitting commingling of product types on said additional shelves (20*b*), (20*c*), (20*d*).

17. The system of claim (1) wherein the surface displays of the one or more display panels (30) are different from one another along the length of the shelf (20*a*).

18. The system of claim 1 wherein said side walls are fixedly joined to a base portion (24) that spans a length 1 of said first horizontal shelf (20*a*).

* * * * *